US009279371B2

(12) United States Patent
Fulton

(10) Patent No.: US 9,279,371 B2
(45) Date of Patent: Mar. 8, 2016

(54) SYSTEM AND METHOD FOR MONITORING AN ENGINE AND LIMITING CYLINDER AIR CHARGE

(75) Inventor: Brien Lloyd Fulton, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1002 days.

(21) Appl. No.: 13/443,663

(22) Filed: Apr. 10, 2012

(65) Prior Publication Data

US 2013/0268178 A1 Oct. 10, 2013

(51) Int. Cl.

| | |
|---|---|
| ***F02D 41/30*** | (2006.01) |
| ***F02D 41/22*** | (2006.01) |
| ***F02D 11/10*** | (2006.01) |
| ***F02D 41/38*** | (2006.01) |

(52) U.S. Cl.

CPC ..... *F02D 11/10* (2013.01); *F02D 41/22* (2013.01); *F02D 41/3836* (2013.01); *F02D 2041/224* (2013.01); *F02D 2200/0602* (2013.01); *F02D 2200/0604* (2013.01); *F02D 2200/0606* (2013.01)

(58) Field of Classification Search

CPC ..... F02D 11/10; F02D 2041/224; F02D 2200/0602; F02D 2200/0606; F02D 2200/0604; F02D 41/3836; F02D 41/22; F02D 2041/223; F02D 1/06

USPC ..... 123/456; 701/102–104, 107

See application file for complete search history.

(56) References Cited

U.S. PATENT DOCUMENTS

| | | | | |
|---|---|---|---|---|
| 5,237,975 | A * | 8/1993 | Betki et al. | 123/497 |
| 5,614,664 | A * | 3/1997 | Yamagishi | 73/114.38 |
| 6,549,857 | B2 | 4/2003 | Fierro et al. | |
| 6,840,219 | B2 * | 1/2005 | Joos et al. | 123/456 |
| 6,889,656 | B1 * | 5/2005 | Rembold et al. | 123/446 |
| 7,287,515 | B2 * | 10/2007 | Okamura et al. | 123/494 |
| 7,363,916 | B2 * | 4/2008 | Eser et al. | 123/497 |
| 2004/0007209 | A1 * | 1/2004 | Ohtani | 123/431 |
| 2005/0257775 | A1 * | 11/2005 | Kojima | 123/458 |
| 2010/0282213 | A1 * | 11/2010 | Yoshikawa et al. | 123/456 |
| 2013/0054124 | A1 * | 2/2013 | Stoll et al. | 701/112 |
| 2013/0080032 | A1 * | 3/2013 | Kaneko et al. | 701/103 |
| 2014/0299103 | A1 * | 10/2014 | Yanoto | 123/447 |

* cited by examiner

*Primary Examiner* — Hieu T Vo
*Assistant Examiner* — Arnold Castro
(74) *Attorney, Agent, or Firm* — Julia Voutyras; Alleman Hall McCoy Russell & Tuttle LLP

(57) ABSTRACT

Methods and systems for monitoring an internal combustion engine are disclosed. In one example, output of a temperature sensor is converted into a fuel pressure variable to determine if fuel system components are operating as desired and cylinder air charge may be limited if degradation is determined. The methods and systems may reduce fuel system cost while also providing redundant system data.

20 Claims, 4 Drawing Sheets

SYSTEM AND METHOD FOR MONITORING AN ENGINE AND LIMITING CYLINDER AIR CHARGE

FIELD

The present description relates to monitoring an engine. In one example, a method for limiting cylinder air charge is disclosed. The approach may be particularly useful for engines that include diagnostics.

BACKGROUND/SUMMARY

Fuel injection systems for internal combustion engines may include pressure sensors to provide feedback of fuel pressure to a fuel control system so that a desired fuel pressure may be provided to an engine. Since the amount of fuel injected to an engine may be affected by a pressure at which the fuel is delivered, it may be desirable to confirm that fuel is being provided at a desired pressure. If fuel is not provided at the desired pressure, engine emissions and performance may degrade. Further, it may be desirable to limit engine air charge during such conditions to limit engine torque. Therefore, it may desirable to ascertain whether or not fuel is being delivered at the desired pressure and whether or not the fuel pressure sensor is operating in a desired manner. One way to confirm fuel pressure sensor operation is to provide multiple fuel sensors to measure fuel pressure. However, providing multiple fuel pressure sensors that provide substantially the same function can increase system cost. Additionally, fuel pressure sensors may be selected to provide pressure readings over a large span of pressures. Consequently, output from the pressure sensors may not provide as much resolution as is desired for relatively small changes in fuel pressure.

The inventor herein has recognized the above-mentioned disadvantages and has developed a method for monitoring engine fuel pressure, comprising: commanding a first actuator to cause a change in fuel pressure; adjusting a second actuator in response to a change in fuel temperature that occurs from commanding the actuator to cause a change in fuel pressure; and limiting cylinder air charge to less than a threshold via the second actuator.

In this way, output from a fuel temperature sensor may sense fuel temperature at times when fuel temperature can be converted in to a variable that is indicative of fuel pressure. Further, the variable can be compared against output of a pressure sensor to determine if there is a desired correlation between the pressure sensor output and the temperature sensor output. In one example, fuel pressure is inferred from fuel pressure based on adiabatic compression of the fuel and cylinder air charge is limited when there is a disagreement between fuel pressure estimates.

The present description may provide several advantages. Specifically, the approach may reduce system cost while providing redundant sensing of fuel pressure. Further, the approach may be useful for identifying degradation of temperature or pressure sensors. Further still, the approach may be implemented in existing fuel systems without having to extensively redesign the fuel systems.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
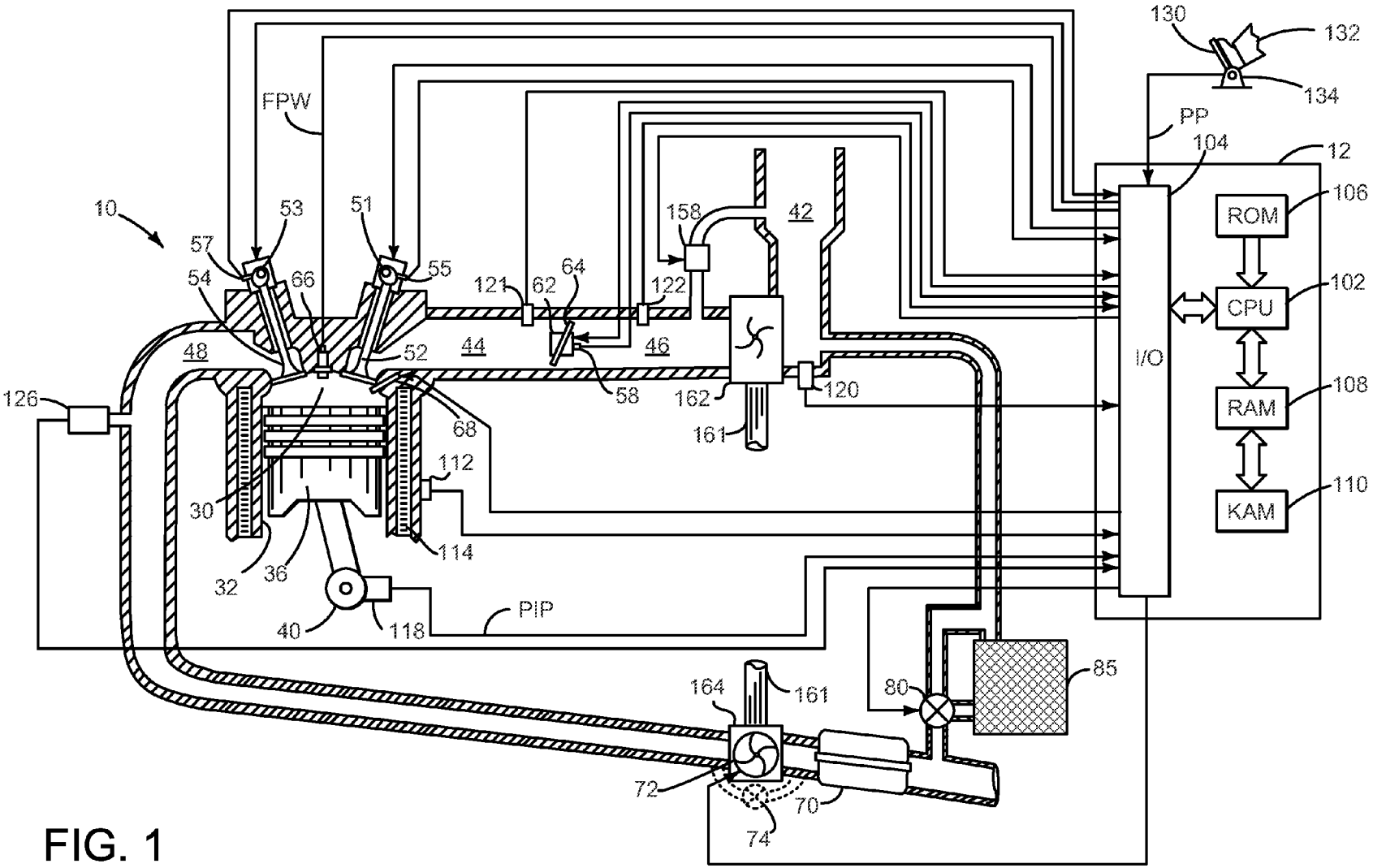
FIG. 1 shows a schematic depiction of an engine.
Figure 2:
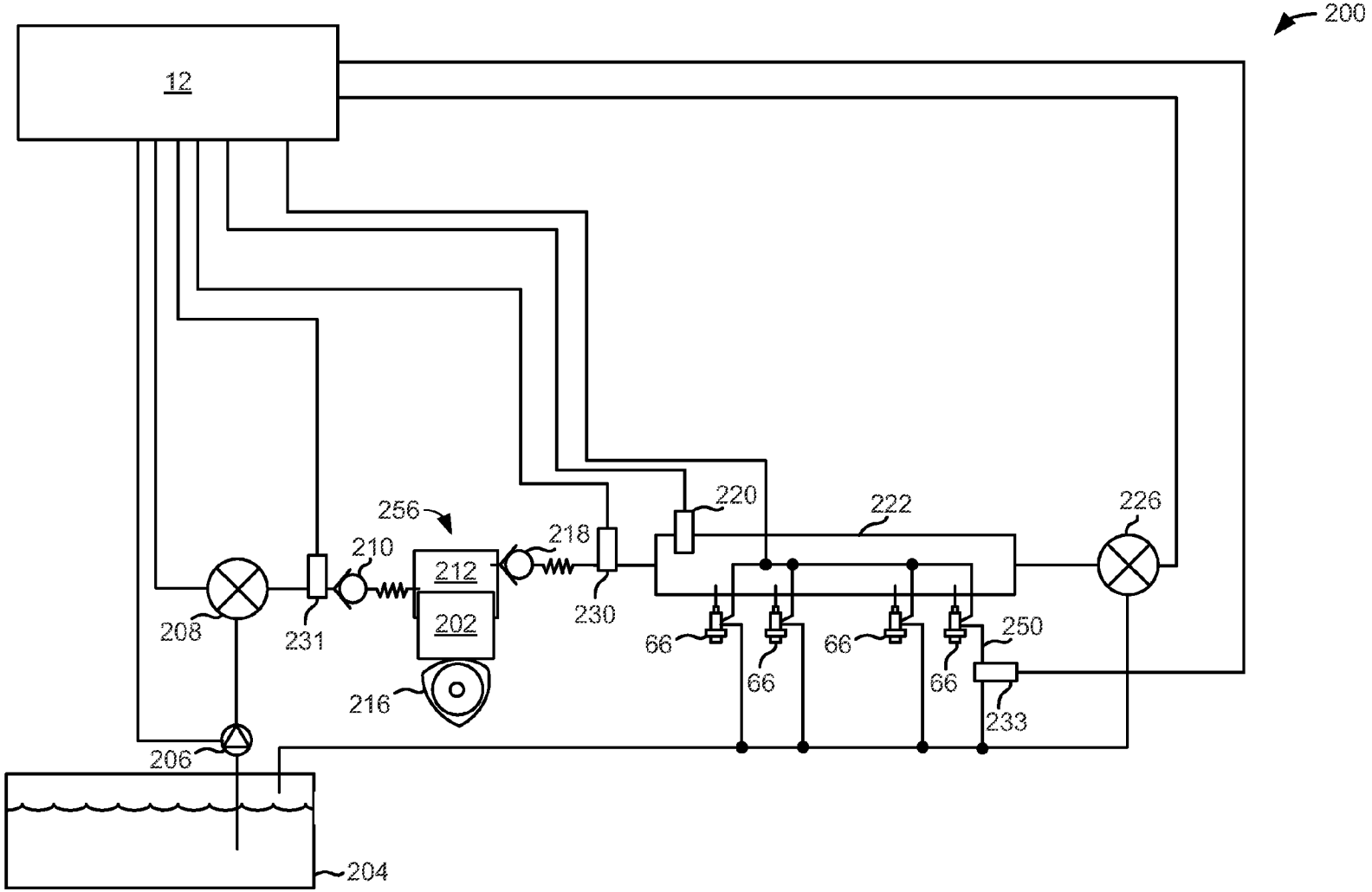
FIG. 2 shows a detailed depiction of a fuel system that supplies fuel to the engine.

The present description is related to monitoring operating conditions of a fuel system. The fuel system provides fuel to an engine. FIG. 1 shows one example of an engine although the systems and method disclosed is applicable to compression ignition engines, compression ignition engines, and turbines. In one example, output of a fuel temperature sensor is compared to output of a fuel pressure sensor in a system as is shown in FIG. 2. Example sequences for monitoring a fuel system are included in FIG. 3. Finally, FIG. 4 provides a flow chart of an example method for monitoring a fuel system.

Referring now to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57.

Fuel injector 66 is shown positioned to inject fuel directly into combustion chamber 30, which is known to those skilled in the art as direct injection. Fuel injector 66 delivers fuel in proportion to the pulse width of signal FPW from controller 12. Fuel is delivered to fuel injector 66 by a fuel system as shown in FIG. 2. Fuel pressure delivered by the fuel system may be adjusted by varying an inlet metering valve regulating flow to a fuel pump (not shown) and a fuel rail pressure control valve.

Intake manifold 44 is shown communicating with optional electronic throttle 62 which adjusts a position of throttle plate 64 to control air flow from intake boost chamber 46. Compressor 162 draws air from air intake 42 to supply boost chamber 46. Exhaust gases spin turbine 164 which is coupled to compressor 162 via shaft 161. In some examples, a charge air cooler may be provided. Compressor speed may be adjusted via adjusting a position of variable vane control 72 or compressor bypass valve 158. In alternative examples, a waste gate 74 may replace or be used in addition to variable vane control 72. Variable vane control 72 adjusts a position of variable geometry turbine vanes. Exhaust gases can pass through turbine 164 supplying little energy to rotate turbine 164 when vanes are in an open position. Exhaust gases can pass through turbine 164 and impart increased force on turbine 164 when vanes are in a closed position. Alternatively, wastegate 74 allows exhaust gases to flow around turbine 164 so as to reduce the amount of energy supplied to the turbine.

Compressor bypass valve 158 allows compressed air at the outlet of compressor 162 to be returned to the input of compressor 162. In this way, the efficiency of compressor 162 may be reduced so as to affect the flow of compressor 162 and reduce the possibility of compressor surge.

Combustion is initiated in combustion chamber 30 when fuel ignites without a dedicated spark source such as a spark plug as piston 36 approaches top-dead-center compression stroke and cylinder pressure increases. In some examples, a universal Exhaust Gas Oxygen (UEGO) sensor 126 may be coupled to exhaust manifold 48 upstream of emissions device 70. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures glow plug 68 may convert electrical energy into thermal energy so as to raise a temperature in combustion chamber 30. By raising temperature of combustion chamber 30, it may be easier to ignite a cylinder air-fuel mixture via compression.

Emissions device 70 can include a particulate filter and catalyst bricks, in one example. In another example, multiple emission control devices, each with multiple bricks, can be used. Emissions device 70 can include an oxidation catalyst in one example. In other examples, the emissions device may include a lean NOx trap or a selective catalyst reduction (SCR), and/or a diesel particulate filter (DPF).

Exhaust gas recirculation (EGR) may be provided to the engine via EGR valve 80. EGR valve 80 is a three-way valve that closes or allows exhaust gas to flow from downstream of emissions device 70 to a location in the engine air intake system upstream of compressor 162. In alternative examples, EGR may flow from upstream of turbine 164 to intake manifold 44. EGR may bypass EGR cooler 85, or alternatively, EGR may be cooled via passing through EGR cooler 85. In other, examples high pressure and low pressure EGR system may be provided.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a measurement of engine manifold pressure (MAP) from pressure sensor 121 coupled to intake manifold 44; boost pressure from pressure sensor 122 exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle. In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

Referring now to FIG. 2, a detailed depiction of a fuel system that supplies fuel an engine is shown. The fuel system of FIG. 2 may be monitored in the engine system of FIG. 1 via the method of FIG. 4.

Fuel system 200 includes various valves and pumps that are controlled by controller 12. Fuel pressure in fuel rail 222 is sensed via pressure sensor 220. Controller 12 controls pressure in fuel rail 222 using pressure feedback from pressure sensor 220. Controller 12 activates fuel pump 206 to supply fuel to fuel pump flow metering valve 208. Check valve 210 allows fuel to flow to high pressure fuel pump 256 and limit back flow from high pressure fuel pump 256. Fuel pump flow metering valve 208 controls the amount of fuel entering high pressure fuel pump 256. Cam 216 is driven by the engine and provides motive force to piston 202 which operates on fuel in pump chamber 212.

High pressure fuel pump 256 directs fuel to fuel injector rail 222 via check valve 218. Fuel pressure in fuel rail 222 may be controlled via adjusting valves 208 and 226. Fuel rail pressure control valve 226 may be positioned partially open during operating conditions such that at least a portion of fuel supplied by fuel pump 256 returns to fuel tank 204. Fuel rail pressure control valves 226 may be at least partially opened an additional amount during some conditions to reduce fuel pressure in the fuel rail 222. Fuel rail pressure control valve 226 may be at least partially closed during some conditions to increase fuel pressure in fuel rail 222. Fuel rail 222 may provide fuel to one cylinder bank of an engine via fuel injectors 66. In other examples, another fuel rail (not shown) supplies fuel to a second cylinder bank of the engine via fuel injectors. Fuel rail pressure control valve 226 may be controlled separately from fuel pump flow metering valve 208 so that fuel pressure in fuel rail 222 may be adjusted by which ever valve or combination of valves provides a desired fuel pressure response.

Fuel temperature is monitored by temperature sensors 230 and 231. Sensor 231 senses fuel temperature before fuel pump 256 performs work on the fuel. Sensor 230 senses fuel temperature after fuel pump 256 performs work on the fuel. Sensor 230 may be placed at fuel rail 222 if desired. In some examples, fuel temperature may be sensed in a fuel return line 250 via temperature sensor 233.

Thus, the system of FIGS. 1 and 2 provide for an engine system, comprising: a cylinder; a fuel rail; a fuel injector in fluidic communication with the fuel rail and directly injecting fuel into the cylinder; and a controller including a computer program stored in a non-transitory medium including executable instructions to adjust an actuator in response to a fuel pressure estimate provided solely via a temperature sensor. The engine system further comprises a pressure sensor and a fuel pump, the pressure sensor located downstream of the fuel pump and coupled to the fuel rail. The engine system further comprises additional instructions to compare an output of the pressure sensor to an output of the temperature sensor. The engine system includes where the actuator is a throttle or a fuel injector. The engine system also includes where the cylinder is in an engine, and further comprising limiting output of the engine in response to the fuel pressure estimate. The engine system further comprises additional executable instructions to provide an indication of degradation in response to the fuel pressure estimate provided solely via the temperature sensor.

Figure 3:
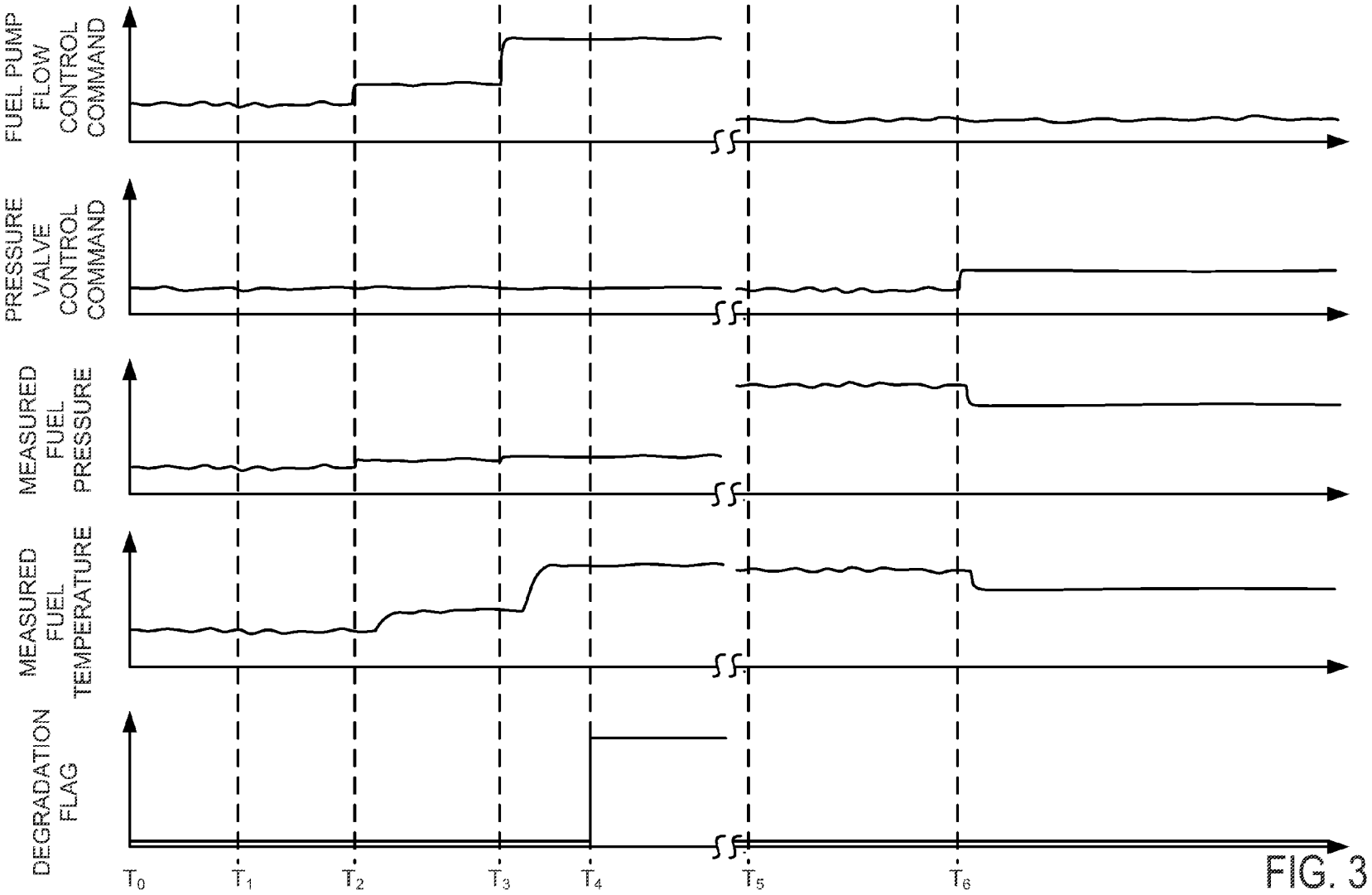
FIG. 3 shows an example simulated plot of signals of interest when monitoring a fuel system.
Figure 4:
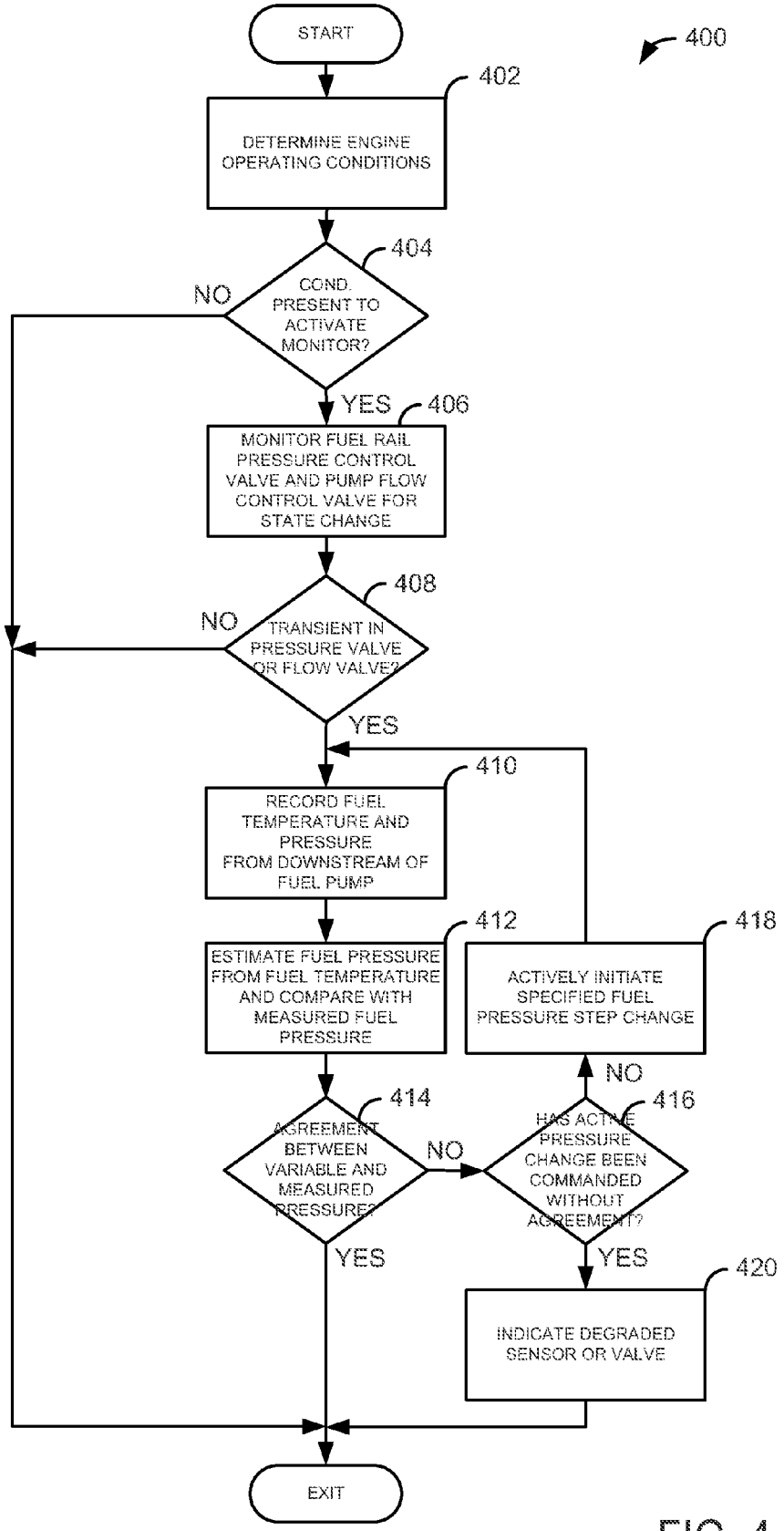
FIG. 4 shows flow chart of an example method for monitoring a fuel system.

Referring now to FIG. 3, an example simulated plot of signals of interest when monitoring a fuel is shown. The sequence of FIG. 3 may be provided via controller 12 executing instructions of the method shown in FIG. 4. Vertical markers $T_0$-$T_6$ indicate times of particular interest in the sequence.

FIG. 3 includes five plots and each of the five plots includes an X axis that represents time. Time increases from the left side of FIG. 3 to the right side of FIG. 3 in the direction of the X axis arrows.

The first plot from the top of FIG. 3 represents a fuel pump flow control command. The fuel pump flow command is issued to a fuel pump flow metering valve 208 as shown in FIG. 2. The fuel pump flow control command increases in the direction of the Y axis arrow. Fuel flow into a high pressure fuel pump is increased as the fuel flow control command increases.

The second plot from the top of FIG. 3 represents a fuel pressure valve control command. The fuel pressure valve control command is issued to a fuel pressure control valve 226 as shown in FIG. 2. The fuel pressure valve control command increases in the direction of the Y axis arrow. The fuel pressure valve command opens the fuel pressure valve more to thereby reduce fuel pressure in the fuel rail 222 when the fuel pressure valve command increases.

The third plot from the top of FIG. 3 represents a measured fuel pressure. The fuel pressure may be sensed in a fuel rail or downstream of a fuel pump as shown in FIG. 2 at 220. The fuel pressure increases in the direction of the Y axis arrow.

The fourth plot from the top of FIG. 3 represents a measured fuel temperature. The fuel temperature may be sensed in a fuel rail or downstream of a fuel pump as shown in FIG. 2 at 230. The fuel temperature increases in the direction of the Y axis arrow.

The fifth plot from the top of FIG. 3 represents a state of a degradation flag. The degradation flag may provide an indication of fuel temperature sensor degradation, fuel pressure sensor degradation, and/or degradation of the fuel pump, fuel pump flow metering valve, and the fuel pressure control valve.

FIG. 3 shows two fuel system monitoring sequences. The two sequences are separated by double SS in the time line of each plot. The double SS designates a break in time and operating conditions between the two sequences.

The first sequence begins at time $T_0$ where the fuel pump flow control command and the pressure valve control command are substantially constant. The positions of the fuel pump flow control command and the pressure valve control command provide fuel to the fuel rail and fuel injectors at a desired pressure. The measured fuel pressure is also substantially constant as is the measured fuel temperature. The degradation flag is at a low level to indicate degradation of the fuel system is not indicated.

At time $T_1$, the fuel system enters a diagnostic mode where the fuel pressure and fuel pressure sensor operation are monitored. The diagnostic mode may be entered when a group of predetermined conditions are met. For example, the diagnostic mode may be entered at a predetermined time after engine start. In another example, the diagnostic mode may be entered when engine operating conditions such as demanded engine torque are substantially constant.

Entry into the fuel system monitor mode includes sampling and monitoring fuel temperatures and pressures. The fuel temperatures and pressures may be sampled at the locations shown in FIG. 2.

At time $T_2$, a command to change and increase the fuel pressure is provided by increasing the fuel pump flow control command. The fuel pressure may be increased in response to a torque request from an operator, but the fuel pressure change at this time is not an actively induced change in fuel pressure related to entering the monitor mode. Increasing the fuel pump flow control command allows additional fuel to enter the fuel pump 256 so that pressure in the fuel rail 222 may be increased. The pressure valve control command is held at substantially the same level as before time $T_2$. The measured fuel pressure changes very little in response to increasing the fuel pump flow control command. On the other hand, the measured fuel temperature increases a short time after the fuel pump flow control command is increased.

The measured fuel temperature is converted into an estimated fuel pressure between time $T_2$ and time $T_3$ as described in greater detail in the description of FIG. 4 The estimated fuel pressure derived from the fuel temperature is compared to the measured fuel pressure and an error greater than a threshold is determined to be present. Consequently, the fuel system enters a portion of the fuel monitoring mode where the fuel pressure sensor is actively adjusted and monitored via commanding an increased fuel pressure from the fuel diagnostic routine without input from the engine operator.

The fuel pressure increase is commanded at time $T_3$ as indicated by the fuel pump flow command increasing in magnitude. In this example, the fuel pump flow control command is increased in a step-wise manner. However, the fuel pump flow control command may be ramped if desired. The change in the fuel pump flow command causes little change in the measured fuel pressure, but the measured fuel temperature increases more significantly. The measured fuel temperature is converted into an estimated fuel pressure and it is compared to the measured fuel pressure. Since there is a error in fuel pressure greater than a threshold level, the degradation flag is asserted at time $T_4$.

In some examples, the engine control system may enter into a limited operating mode when the degradation flag is asserted. In one example, the throttle opening amount and fuel injector opening amount may be limited so as to limit engine torque. Turbocharger boost may also be limited when the degradation flag is asserted.

Thus, when there is a difference between an estimated fuel pressure and a measured fuel pressure, engine operation may be limited. Further, the estimated fuel pressure is based solely on output of a fuel temperature sensor. The fuel temperature sensor may be monitored downstream of a fuel pump that works on the fuel to increase fuel pressure.

The second sequence begins at time $T_5$, where the fuel system enters the monitor mode. The fuel system may enter monitor mode in response to operating conditions as described above. The fuel pump flow control command and the pressure valve control command are substantially constant. The measured fuel temperature and pressure are also substantially constant. The fuel system degradation flag is not asserted indicating no fuel system degradation has been determined.

At time $T_6$, a decrease in fuel pressure is commanded via opening the fuel pressure control valve as indicated by increasing the fuel pressure valve control command. The measured fuel pressure follows the fuel pressure valve control command and decreases shortly thereafter. The measured fuel temperature also decreases and it causes the fuel pressure that is estimated from fuel temperature to be decreased as well. In this example, there is less error between the measured fuel pressure and the estimated fuel pressure than a threshold. Consequently, the degradation flag is not asserted and the fuel system does not enter an active fuel monitor mode as shown in the first sequence of FIG. 3.

It may be observed that the measured fuel temperature exhibits a small flat delay from the change in fuel pressure command to the time when fuel temperature increases. Further, the measured fuel temperature may also exhibit a response indicative of a longer time constant. As such, the fuel system may time align the data removing the flat delay and compensating for the time constant. Alternatively, the method described herein may wait for a period of the flat delay plus two time constants before comparing the measured pressure with the pressure estimated from the fuel temperature.

Referring now to FIG. 4, a flow chart of a method for monitoring a fuel system is shown. The method of FIG. 4 may be included in the system shown in FIGS. 1 and 2 via executable instructions stored in non-transitory memory. The method of FIG. 4 may provide the sequence shown in FIG. 3.

At 402, method 400 determines operating conditions. Operating conditions may include but are not limited to engine speed, engine torque command, fuel pressure, fuel temperature, ambient pressure, and ambient temperature. Method 400 proceeds to 404 after operating conditions are determined.

At 404, method 400 judges whether or not operating conditions are present to enter a passive portion of a fuel system monitor. In one example, the system may enter the fuel system monitor mode after the engine has been operating for a predetermined amount of time and when the engine is operating at substantially constant operating conditions (e.g., constant engine speed and load). If method 400 judges that operating conditions are present to enter the fuel system monitor mode, the answer is yes and method 400 proceeds to 406. Otherwise, the answer is no and method 400 proceeds to exit.

At 406, method 400 begins to monitor fuel system pressure and temperature. The fuel temperature and pressure may be monitored at locations as indicated in FIG. 2. Method 400 also monitors the operating state of the fuel pressure valve control command and the fuel pump flow control command. The fuel pump flow control command and fuel pressure valve control command may be monitored as variables within the controller or via hardware. Method 400 proceeds to 408 after fuel temperatures, fuel pressure, the fuel pump flow control command, and the fuel pressure valve control command are monitored and sampled to determine their respective states. Additionally, fuel temperature, fuel pressure, the fuel pump flow control command, and the fuel pressure valve control command may be stored or recorded to memory as initial conditions before a transient change in fuel pressure.

At 408, method 400 judges whether or not there is a transient conditions (e.g., a change in a variable greater than a threshold level) in the fuel pressure valve control command or the fuel pump flow control command to determine if the fuel pump flow metering valve or the fuel pressure control valve is being adjusted via an operator torque command or another command external to the method of FIG. 4. If method 400 determines that a change in fuel pressure is present, the answer is yes and method 400 proceeds to 410. Otherwise, the answer is no and method 400 proceeds to exit.

At 410, method 400 records fuel temperature and pressure from locations downstream of a fuel pump. The locations may be as indicated in FIG. 2. In one example, fuel temperature and pressure are recorded to memory for processing at a later time. Alternatively, fuel temperature and pressure may be processed real-time. Further, the fuel temperature and fuel pressure may be sampled within a predetermined amount of time since the transient is detected at 408. Method 400 proceeds to 412 after fuel temperature and pressure are processed and recorded.

At 412, method 400 estimates fuel pressure from fuel temperature and compares the estimated fuel pressure with the measured fuel pressure (e.g., fuel pressure determined from the fuel pressure sensor). In one example, fuel pressure is estimated based on adiabatic compression and expansion from fuel temperature according to the equation:

$$T_2 = \frac{\int P dv}{\dot{m} c_p} - T_1$$

Where $T_2$ is the ending temperature, P is pressure being estimated, $T_1$ is initial temperature, $c_p$ is specific heat of the fuel, and $\dot{m}$ is the mass flow rate through the fuel pump. In this way, fuel pressure may be found given the initial fuel temperatures. The mass flow rate through the fuel pump may be estimated from pump speed and the position or volume command of the fuel pump flow metering valve.

In one example, the fuel temperature is input to an equation based on a least squares regression from measured fuel pressure and fuel temperature to estimate fuel pressure. Further, if desired, coefficients of derived from the regression may include sensitivity for pump speed, thermal mass of the fuel, rail pressure, and other factors if desired. In other examples, a model may be constructed directly from the adiabatic equation above.

Once fuel pressure is estimated an error may be determined by subtracting the estimated fuel pressure from the measured fuel pressure. The error may then be compared to a predetermined threshold to determine if degradation is present. In some examples, the estimated fuel pressure and the measured fuel pressure may be compared to a second estimated fuel pressure that is based on the fuel pressure valve control command or the fuel pump flow control command. If there is good agreement between the two estimated fuel pressures and poor agreement with the measured fuel pressure, it may be determined that the fuel pressure sensor is degraded. If there is good agreement between the fuel pressure estimate from fuel temperature and the measured fuel pressure but not with the estimated fuel pressure from the fuel pump flow control command, it may be determined that the fuel pump, fuel pump metering valve, or fuel pressure valve are degraded. On the other hand, if there is good agreement between the measured fuel pressure and the fuel pressure estimated from the fuel pump flow control command but not the estimated fuel pressure from the fuel temperature, it may be determined that the fuel temperature sensor is degraded. Method 400 proceeds to 414 after the fuel pressure is estimated from fuel temperature.

At 414, method 400 judges whether or not there is agreement between a variable that represents fuel pressure estimated from fuel temperature and the measured fuel pressure. In one example, good agreement is present when the difference between the measured fuel pressure and the estimated fuel pressure is less than a threshold value. If the estimated fuel pressure and the measured fuel pressure are in agreement, the answer is yes and method 400 proceeds to exit. If there is not good agreement between the measured fuel pressure and the estimated fuel pressure, the answer is no and method 400 proceeds to 416.

At 416, method 400 judges whether or not an active pressure change has been commanded without there being good agreement between the measured fuel pressure and the fuel pressure estimated from the fuel temperature. If no active pressure change has been commanded, the answer is no and method 400 proceeds to 418. If an active pressure change has been commanded and there is no agreement between the measured fuel pressure and fuel pressure estimated from fuel temperature, the answer is yes and method 400 proceeds to 420.

At 418, method 400 commands a change in fuel pressure. The fuel pressure change may be commanded via adjusting the fuel pump flow control command or via adjusting the fuel pressure valve control command. The fuel pressure may be increased or decreased. Further, fuel injection timing is adjusted as the fuel pressure is adjusted so that the desired amount of fuel is delivered to engine cylinders. The fuel pressure change may be commanded as a step change or a ramp change. Thus, at 418 a change in fuel pressure is commanded without input via the operator and thus fuel pressure is actively adjusted and monitored. Further, the transient fuel pressure condition at 408 occurs at an earlier in time cylinder cycle than the transient fuel pressure condition provided at 418. Method 400 returns to 410 after the fuel pressure change is commanded.

At 420, method 400 indicates a degraded condition of the fuel system. In some examples, the degradation may be more specifically indicated as described above with reference to the fuel temperature sensor, the fuel pressure sensor, or other fuel system components. Further, engine operation may be limited during a condition of degradation via limiting throttle opening time or fuel injection duration. Thus, cylinder air charge of engine cylinders is limited to less than a threshold in response to a disagreement between fuel pressure estimates. In this way, engine torque may be limited to reduce the possibility of injecting more or less fuel than is desired.

Thus, the method of FIG. 4 provides for monitoring an engine, comprising: commanding a first actuator to cause a change in fuel pressure; adjusting a second actuator in response to a change in fuel temperature that occurs from commanding the actuator to cause a change in fuel pressure; and limiting cylinder air charge to less than a threshold via the second actuator. The method includes where the first actuator is a fuel rail pressure control valve, and where the second actuator is a throttle. The method includes where the first actuator is a fuel pump flow metering valve, and where the second actuator is a fuel injector. In this way, sensor degradation may be diagnosed and compensated.

In one example, the method includes where the first actuator is commanded in response to an operator torque request. The method also includes where first actuator is not commanded in response to an operator torque request. The method also includes where commanding the first actuator to cause a change in fuel pressure is performed during a first cycle of a cylinder in response to an operator torque request, and further comprising where during a second cycle the first actuator is commanded independent of the operator torque request to cause a change in fuel pressure when the change is fuel temperature is outside a predetermined range. The method also includes where the change in fuel temperature is determined within a predetermined time after commanding the first actuator.

In another example, FIG. 4 provides a method for monitoring an engine, comprising: commanding a first actuator to cause a change in fuel pressure downstream of a fuel pump; and adjusting a second actuator in response to a comparison between a fuel pressure sensor output and a temperature sensor output. The method includes where the comparison includes determining an error between a first variable determined from the fuel pressure sensor output and a second variable determined from the temperature sensor output. The method also includes where the comparison includes comparing the error to a predetermined value and providing an indication of degradation when the error is greater than the predetermined value. The method also includes where the first actuator is a fuel pressure control valve or a fuel pump flow control valve. The method further includes where the second actuator is a throttle or a fuel injector. The method further comprises converting the temperature sensor output to a variable indicative of fuel pressure. The method also includes where the temperature sensor output is input to an equation based on a regression to provide the variable indicative of fuel pressure.

As will be appreciated by one of ordinary skill in the art, the method described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps, methods, or functions may be repeatedly performed depending on the particular strategy being used.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. A method for monitoring an engine, comprising:

commanding a first actuator to cause a change in fuel pressure;

adjusting a second actuator in response to a change in fuel temperature that occurs from commanding the first actuator to cause a change in fuel pressure; and limiting cylinder air charge to less than a threshold via the second actuator.

2. The method of claim 1, where the first actuator is a fuel rail pressure control valve, and where the second actuator is a throttle.

3. The method of claim 1, where the first actuator is a fuel pump flow metering valve.

4. The method of claim 1, where the first actuator is commanded in response to an operator torque request.

5. The method of claim 1, where the first actuator is not commanded in response to an operator torque request.

6. The method of claim 1, where commanding the first actuator to cause a change in fuel pressure is performed during a first cycle of a cylinder in response to an operator torque request, and further comprising where during a second cycle the first actuator is commanded independent of the operator torque request to cause a change in fuel pressure when the change in fuel temperature is outside a predetermined range.

7. The method of claim 1, where the change in fuel temperature is determined within a predetermined time after commanding the first actuator.

8. A method for monitoring an engine, comprising:

commanding a first actuator to cause a change in fuel pressure downstream of a fuel pump; and adjusting a second actuator in response to a comparison between a fuel pressure sensor output and a temperature sensor output.

9. The method of claim 8, where the comparison includes determining an error between a first variable determined from the fuel pressure sensor output and a second variable determined from the temperature sensor output.

10. The method of claim 9, where the comparison includes comparing the error to a predetermined value and providing an indication of degradation when the error is greater than the predetermined value.

11. The method of claim 8, where the first actuator is a fuel pressure control valve or a fuel pump flow control valve.

12. The method of claim 8, where the second actuator is a throttle or a fuel injector.

13. The method of claim 8, further comprising converting the temperature sensor output to a variable indicative of fuel pressure.

14. The method of claim 13, where the temperature sensor output is input to an equation based on a regression to provide the variable indicative of fuel pressure.

15. An engine system, comprising:

a cylinder;

a fuel rail;

a fuel injector in fluidic communication with the fuel rail and directly injecting fuel into the cylinder; and a controller including a computer program stored in a non-transitory medium including executable instructions to adjust an actuator in response to a fuel pressure estimate provided via a temperature sensor, a specific heat of a fuel, and a mass flow rate through a fuel pump.

16. The engine system of claim 15, further comprising a pressure sensor and the fuel pump, the pressure sensor located downstream of the fuel pump and coupled to the fuel rail.

17. The engine system of claim 16, further comprising additional instructions to compare an output of the pressure sensor to an output of the temperature sensor.

18. The engine system of claim 15, where the actuator is a throttle or a fuel injector.

19. The engine system of claim 18, where the cylinder is in an engine, and further comprising limiting output of the engine in response to the fuel pressure estimate.

20. The engine system of claim 15, further comprising additional executable instructions to provide an indication of degradation in response to the fuel pressure estimate provided via the temperature sensor, the specific heat of the fuel, and the mass flow rate through the fuel pump.

* * * * *